US010305161B2

(12) United States Patent
Carr et al.

(10) Patent No.: US 10,305,161 B2
(45) Date of Patent: May 28, 2019

(54) METHOD OF PROVIDING DUAL STRIPLINE TILE CIRCULATOR UTILIZING THICK FILM POST-FIRED SUBSTRATE STACKING

(71) Applicant: Raytheon Company, Waltham, MA (US)

(72) Inventors: James A. Carr, Fountain View, CA (US); Mark B. Hanna, Allen, TX (US)

(73) Assignee: RAYTHEON COMPANY, Waltham, MA (US)

( * ) Notice: Subject to any disclaimer, the term of this patent is extended or adjusted under 35 U.S.C. 154(b) by 640 days.

(21) Appl. No.: 14/823,266

(22) Filed: Aug. 11, 2015

(65) Prior Publication Data

US 2015/0364809 A1 Dec. 17, 2015

Related U.S. Application Data

(62) Division of application No. 13/952,020, filed on Jul. 26, 2013, now Pat. No. 9,136,572.

(51) Int. Cl.
*H01P 1/387* (2006.01)
*H01P 11/00* (2006.01)

(52) U.S. Cl.
CPC ..... *H01P 11/003* (2013.01); *H01P 1/387* (2013.01); *Y10T 29/49016* (2015.01); *Y10T 29/49018* (2015.01)

(58) Field of Classification Search
CPC ..... H01P 1/387; H01P 11/003
See application file for complete search history.

(56) References Cited

U.S. PATENT DOCUMENTS 3,286,201 A 11/1966 Roberts
3,758,878 A 9/1973 Wainwright
4,122,418 A 10/1978 Nagao
(Continued)

FOREIGN PATENT DOCUMENTS

JP 2002009508 1/2002

OTHER PUBLICATIONS

Bosma, H., On Stripline Y-Circulation at UHF, IEEE Transactions on Microwave Theory and Techniques, Jan. 1964, pp. 61-72 (12 pages).
Fay, C.E., et al., Operation of the Ferrite Junction Circulator, IEEE Transactions on Microwave Theory and Techniques, Jan. 1965, pp. 15-27 (13 pages).
(Continued)

*Primary Examiner* — Livius Radu Cazan
(74) *Attorney, Agent, or Firm* — Daly, Crowley, Mofford & Durkee, LLP

(57) ABSTRACT

A dual stacked stripline circulator includes multiple composite ferrite discs, each having an inner portion and an outer portion; a first substrate having an edge with a first composite ferrite disc disposed in the first substrate; a second substrate having an edge with a second composite ferrite disc disposed in the second substrate; a third substrate having an edge with a third composite ferrite disc disposed in the third substrate, the third substrate disposed adjacent the second substrate; a fourth substrate having an edge with a fourth composite ferrite disc disposed in the fourth substrate; a first pattern defining three ports of a first three-port circulator disposed between the first substrate and the second substrate; a second pattern defining three ports of a second three-port circulator disposed between the third substrate and the fourth substrate; and a metal film encircling the edge of the first, second, third and fourth substrate.

11 Claims, 8 Drawing Sheets

(56) References Cited

U.S. PATENT DOCUMENTS

| | | | | |
|---|---|---|---|---|
| 4,276,522 | A | 6/1981 | Coerver | |
| 4,390,853 | A * | 6/1983 | Mathew | H01P 1/218 333/1.1 |
| 4,703,289 | A * | 10/1987 | Kwitkowski | H01P 1/387 29/600 |
| 4,791,389 | A | 12/1988 | Wolfert | |
| 4,810,979 | A | 3/1989 | Morz et al. | |
| 5,185,587 | A | 2/1993 | Kurian et al. | |
| 5,347,241 | A | 9/1994 | Panaretos et al. | |
| 5,898,346 | A | 4/1999 | Kamei et al. | |
| 6,633,205 | B2 | 10/2003 | Jussaume et al. | |
| 6,822,524 | B2 | 11/2004 | Hempel et al. | |
| 6,844,789 | B2 | 1/2005 | Lombardi et al. | |
| 7,382,209 | B2 | 6/2008 | Watanabe | |
| 7,385,454 | B2 | 6/2008 | Kingston et al. | |
| 7,495,521 | B2 | 2/2009 | Chen et al. | |
| 2002/0135434 | A1 | 9/2002 | Emanuelsson | |
| 2003/0206074 | A1* | 11/2003 | Heisen | H01P 1/39 333/1.1 |
| 2006/0226924 | A1 | 10/2006 | Chen et al. | |
| 2008/0012779 | A1 | 1/2008 | Chen et al. | |
| 2010/0259336 | A1 | 10/2010 | Bunce et al. | |
| 2011/0068877 | A1* | 3/2011 | Chawla | H01P 1/387 333/1.1 |
| 2011/0193649 | A1 | 8/2011 | Popelka et al. | |
| 2015/0028961 | A1 | 1/2015 | Carr et al. | |

OTHER PUBLICATIONS

Simon, J.W., Broadband Strip-Transmission Line Y-Junction Circulators, IEEE Transactions on Microwave Theory and Techniques, May 1965, pp. 335-345 (11 pages).

Chinmay K. Maiti, D. Bhattacharyya, N.B. Chakrabarti, Fabrication on Nonreciprocal Microwave Components Using Thick Film Ferrimagnetic Pastes, Electrocomponent Science and Technology, 1981, vol. 8, pp. 111-115 (5 pages).

Notification of Transmittal of the International Search Report and the Written Opinion of the International Searching Authority, or the Declaration, PCT/US2014/037441, dated Sep. 26, 2014, 1 page.

International Search Report, PCT/US2014/037441, dated Sep. 26, 2014, 4 pages.

Written Opinion of the International Searching Authority, PCT/US2014/037441, Sep. 26, 2014, 9 pages.

Communication pursuant to Article 94(3) EPC dated Jul. 26, 2018 for European Application No. 14734581.3; 8 Pages.

PCT International Search Report and Written Opinion dated Aug. 31, 2016 for International Application No. PCT/US2016/035747; 19 pages.

PCT Notification Concerning Transmittal of International Preliminary Report on Patentability dated Apr. 26, 2018 for International Application No. PCT/US2016/035747; 14 pages.

Cuviello et al.; This Film High-Density Interconnect (HDI) Design Guidelines. Tech Note TN0002; Jun. 29, 2005. 11 pages.

* cited by examiner

METHOD OF PROVIDING DUAL STRIPLINE TILE CIRCULATOR UTILIZING THICK FILM POST-FIRED SUBSTRATE STACKING

CROSS REFERENCE TO RELATED APPLICATION

This is a divisional application of application Ser. No. 13/952,020 filed Jul. 26, 2014 which application is hereby incorporated herein by reference in its entirety.

STATEMENTS REGARDING FEDERALLY SPONSORED RESEARCH

This invention was made with Government support under Contract No. N00019-10-C-0073 awarded by the Department of the navy. The Government has certain rights in this invention.

FIELD OF THE INVENTION

This disclosure relates generally to radio frequency (RF) antenna arrays and more particularly to a which can be used in the feed structure for such antenna arrays.

BACKGROUND

As is known in the art, feed structures are used to couple a radar or communication system to an array of antenna elements. One component of a feed structure is a circulator. U.S. Pat. No. 5,374,241 entitled "Dual Junction Back-To-Back Microstrip Four-Port Circulators" describes a back-to-back four port microstrip circulator configured from two three-port single junction circulators whose substrates lay back-to-back and are interconnected with a coaxial feedthrough. The teachings of U.S. Pat. No. 5,374,241 describe the advantages of such a configuration.

SUMMARY

In accordance with the present disclosure, a dual stacked stripline circulator includes: a first composite ferrite disc having an inner portion and an outer portion; a second composite ferrite disc having an inner and an outer portion; a third composite ferrite disc having an inner and an outer portion; a fourth composite ferrite disc having an inner and outer portion; a first substrate having an edge with the first composite ferrite disc disposed in the first substrate; a second substrate having and edge with the second composite ferrite disc disposed in the second substrate; a third substrate having an edge with the third composite ferrite disc disposed in the third substrate, the third substrate disposed adjacent the second substrate; a fourth substrate having and edge with the fourth composite ferrite disc disposed in the fourth substrate; a first pattern defining three ports of a first three-port circulator disposed between the first substrate and the second substrate; a second pattern defining three ports of a second three-port circulator disposed between the third substrate and the fourth substrate; and a metal film encircling the edge of the first, second, third and fourth substrate. With such an arrangement, two circulator devices can be packaged in a tile architecture within an antenna lattice spacing required for an antenna having active elements utilizing circulators fabricated using unique thick film processing techniques.

In accordance with the present disclosure, a dual stacked stripline circulator includes multiple composite ferrite discs, each having an inner portion and an outer portion; a first substrate having an edge with a first composite ferrite disc disposed in the first substrate; a second substrate having an edge with a second composite ferrite disc disposed in the second substrate; a third substrate having an edge with a third composite ferrite disc disposed in the third substrate, the third substrate disposed adjacent the second substrate; a fourth substrate having and edge with a fourth composite ferrite disc disposed in the fourth substrate; a first pattern defining three ports of a first three-port circulator disposed between the first substrate and the second substrate; a second pattern defining three ports of a second three-port circulator disposed between the third substrate and the fourth substrate; and a metal film encircling the edge of the first, second, third and fourth substrate. With such an arrangement, a dual stacked stripline circulator is provided suitable for use with a dual polarized active electronically scanned array (AESA) antenna where each radiating element is being actively fed.

In at least one embodiment, each disc includes an inner portion of a high saturation magnetization material and an outer portion of a low saturation magnetization material and the metal film is gold. Furthermore, the inner portion of a high saturation magnetization material is adhered to the outer portion of a low saturation magnetization material using a high temperature adhesive. This construct is commonly used to realize wideband circulators whose ratio of upper operating frequency to lower operating frequency is 3 or greater. Narrower band circulators can be realized using a single ferrite disc of an appropriate saturation magnetization material for the frequency of operation. The methods of this disclosure are applicable to the single ferrite disc as well as the composite ferrite disc.

A method of providing a dual stacked stripline circulator includes: forming a first substrate with a first composite ferrite disc having an inner portion with a high saturation magnetization material and an outer portion of a low saturation magnetization material; forming a second substrate with a second composite ferrite disc having an inner portion with a high saturation magnetization material and an outer portion of a low saturation magnetization material; forming a third substrate with a third composite ferrite disc having an inner portion with a high saturation magnetization material and an outer portion of a low saturation magnetization material; forming a fourth substrate with a fourth composite ferrite disc having an inner portion with a high saturation magnetization material and an outer portion of a low saturation magnetization material; disposing a first pattern defining three ports of a first three-port circulator on each of the first substrate and the second substrate; disposing a second pattern defining three ports of a second three-port circulator on each of the third substrate and the fourth substrate; stacking the first substrate, the second substrate, the third substrate and the fourth substrate; and encircling a metal film around the first, second, third and fourth substrate. With such a technique, a dual stacked stripline circulator is provided compact in size and suitable for use in a feed arrangement for an antenna feed with active elements.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

It should be appreciated that an active electronically scanned array (AESA) antenna requires a circulator component connected to each radiating element. The circulator duplexes the signals from the antenna, routing the transmit signal to the radiating element and the receive signal from the radiating element, while providing isolation between the transmit path and the receive path. An array lattice spacing is typically set at ½ the free space wavelength, which determines the space available for packaging a circulator in the plane of the array. In a dual polarized array, two circulator devices are needed to be packaged within the array lattice spacing, further restricting the space available per circulator. Typically, there are two packaging options, circulator resonator and transmission lines parallel (brick) or perpendicular (tile) to the direction of antenna radiation propagation. Since a circulator's size is much larger in the plane of the resonator and transmission lines, it is easier to package in the brick architecture. However, if the circulators are packaged in the tile architecture, the overall array depth is reduced substantially. This size and weight savings increases as the frequency of operation decreases. This disclosure allows two circulator devices to be packaged in a tile architecture within the antenna lattice spacing utilizing circulators fabricated using unique thick film processing techniques.

Figure 1:
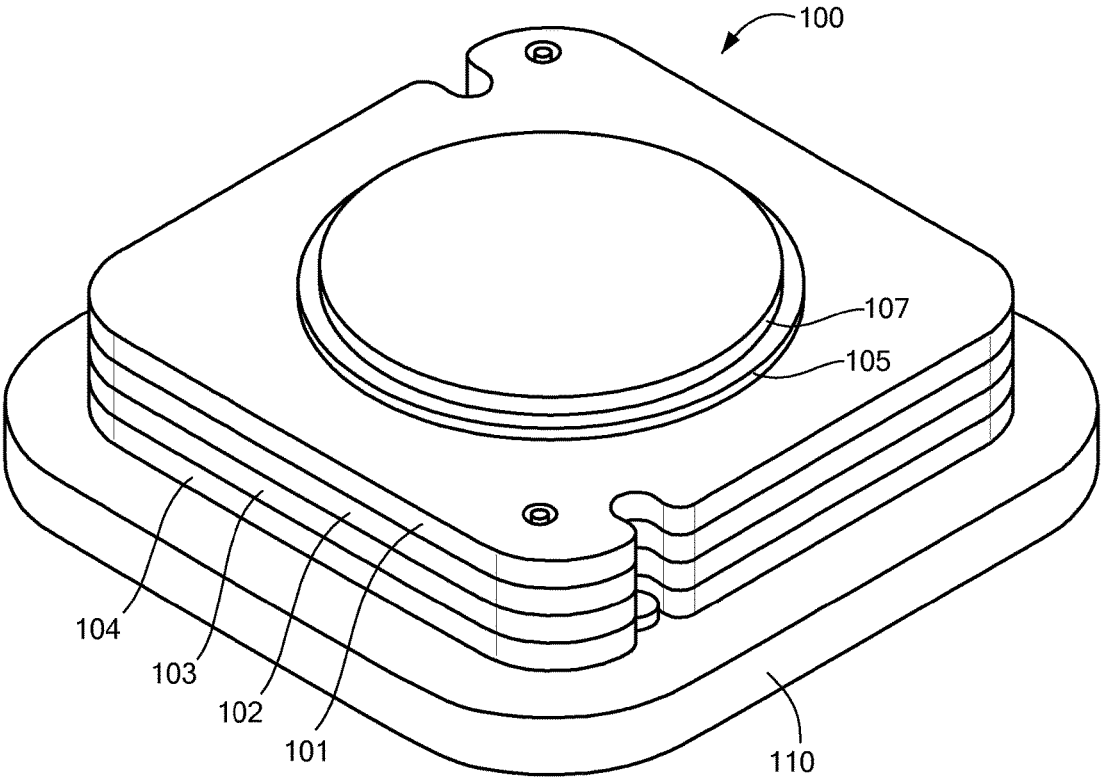
FIG. 1 is a top perspective view of a dual stacked stripline circulator according to the disclosure.
Figure 1A:
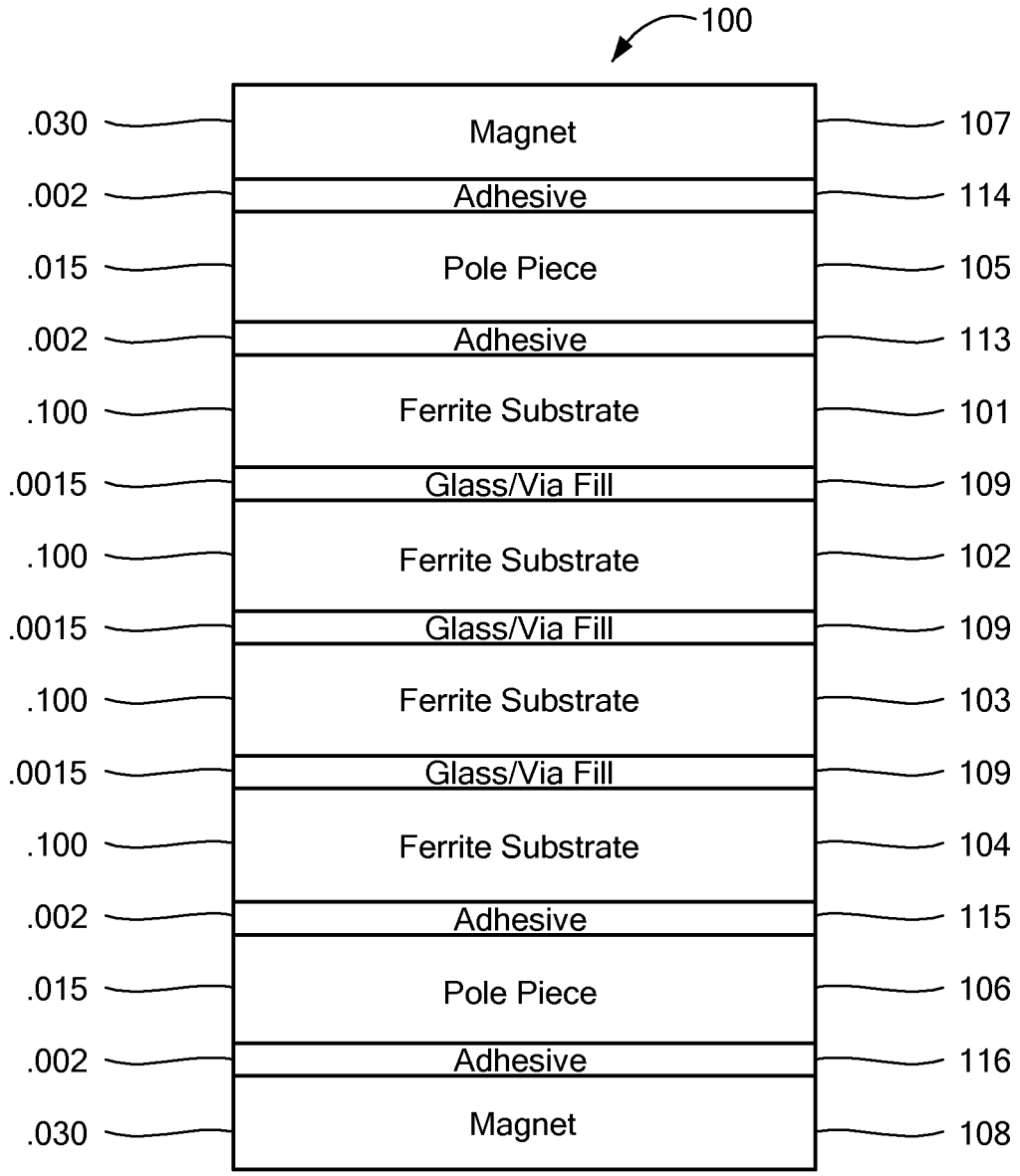
FIG. 1A is a side cross sectional view of a portion of a dual stacked stripline circulator according to the disclosure.
Figure 1B:
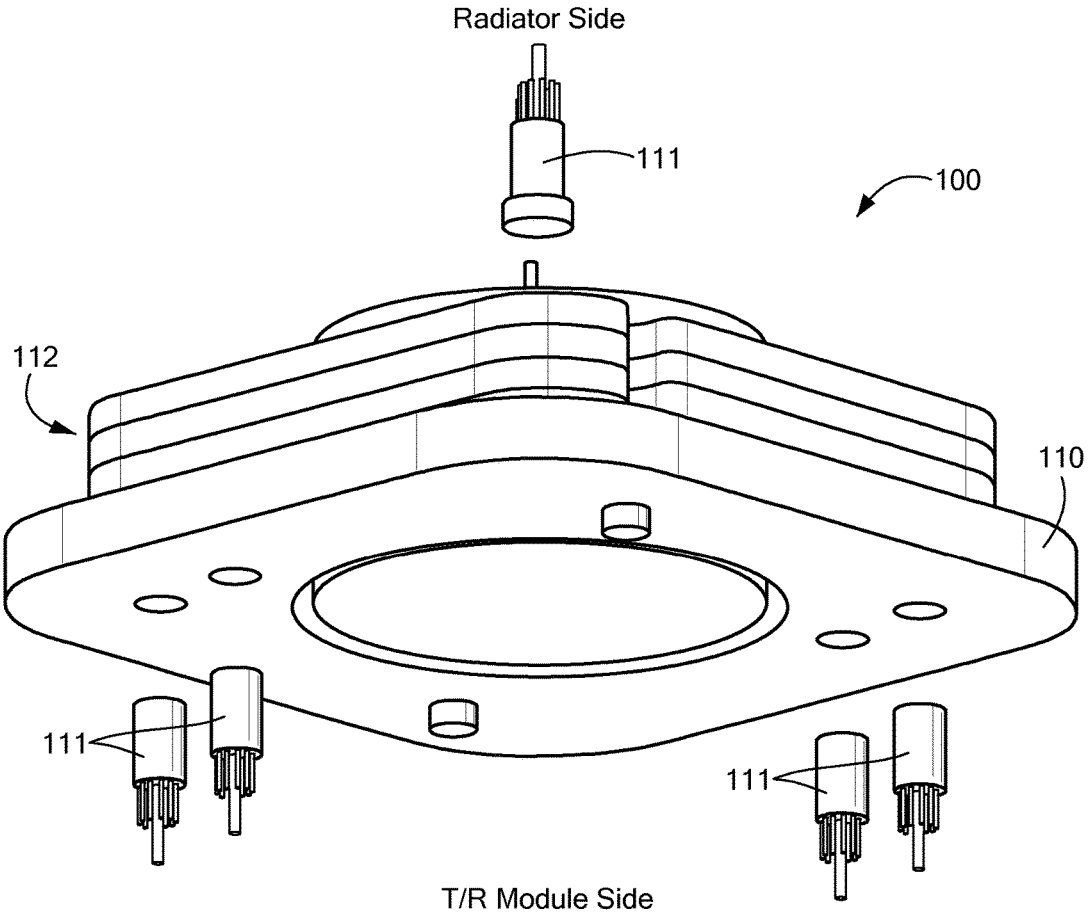
FIG. 1B is a bottom perspective view of a dual stacked stripline circulator according to the disclosure.
Figure 2:
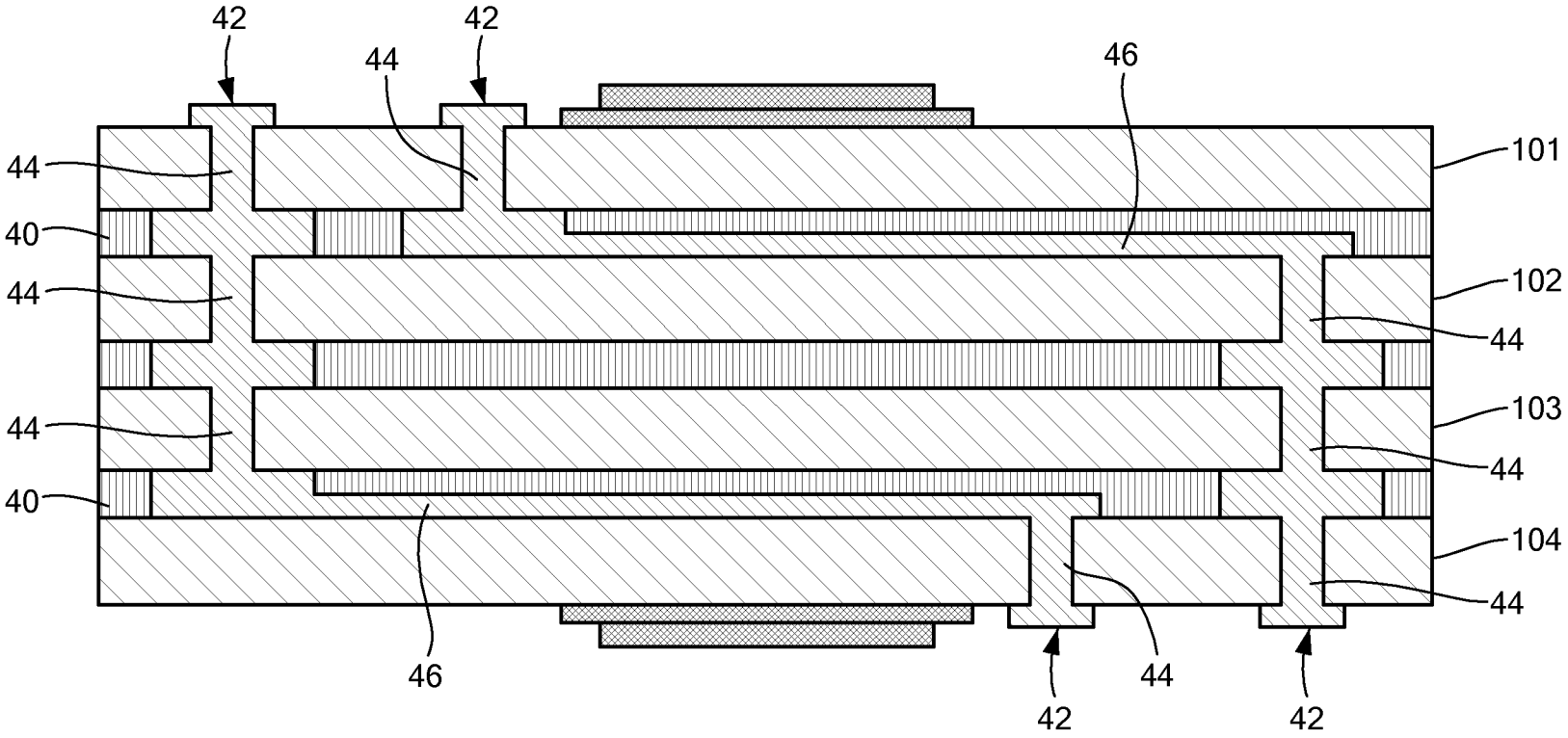
FIG. 2 is a side cross sectional view of a portion of a dual stacked stripline circulator according to the disclosure.

Referring now to FIGS. 1, 1A, 1B and 2, a dual stacked stripline circulator 100 is shown where two stripline circulators are stacked on top of each other for use in the 0.5 to 2.0 GHz band. The dual stacked stripline circulator 100 includes four substrates, substrate 101, substrate 102, substrate 103 and substrate 104. A coldplate 110 is attached to substrate 104. Each circulator includes two substrates for a total of four substrates stacked together to provide the dual stacked stripline circulator 100. A magnetic bias is provided by a magnetic pole piece 105 and permanent magnet 107 and magnetic pole piece 106 and permanent magnet 108 positioned, respectively, on the top and the bottom of the stacked substrate assembly. The interconnections between the circulators and the DR modules (not shown) on the bottom and the circulators and the antenna radiators (not shown) on top are made using coaxial spring probe contacts 111. The dual stacked stripline circulator 100 has coaxial to stripline vertical transitions formed using vias 44 and metallization 46 as shown in FIG. 2 within the stack and connected with RF ports 42. Ground vias provide isolation between the two independent circulators. The four substrates are bonded together, two at a time, using a thick film sealing glass paste 109 (FIG. 1A) as to be described further. The vias 44 are formed in each substrate layer individually and then connected together when the stack is bonded using a low shrinkage gold thick film paste fired at 800 C. The circulator stripline circuit layer is printed and pattern etched on both sides of the substrates and then connected together with wet thick film paste and fired at 800 C. Mirrored patterning and wet attachment processes are used to prevent any gaps between the circuit and substrate since any gap could cause a resonance spike in the operating band. Grounds are connected together on the outside of the entire stack using a low temperature (525 C) thick film paste edge wrap process as to be described. The low firing, low shrinkage edge wrap pastes prevents cracks between the substrate interfaces.

To provide wideband circulators with a bandwidth greater than 2:1, composite ferrite substrates are used. These substrates include a center disc of one ferrite material having a high saturation magnetization material and a ring of another ferrite material having a lower saturation magnetization material surrounding the center disc, and a thermally matched dielectric ceramic material surrounding the ferrite materials. It should be noted that the low saturation magnetization material could also be used instead of the thermally matched dielectric ceramic material as a single element. The processes employed in this disclosure are compatible with the usage of the composite ferrite substrates. This disclosure uses thick film post-fired substrate stacking processes applied to ferrite substrates and/or composite ferrite/dielectic substrates for fabrication as to be described further. The unique aspects of the process are: thick film sealing glass for substrate stack bonding; layer to layer and substrate to substrate via interconnects; metallization and patterning across the gaps between composite materials; and mirrored etched stripline circuit metallization on top and bottom of the substrates and their interconnection. This disclosure uses stacked circulators in a the architecture to reduce depth and weight for a dual-polarized wideband active array antenna. The overall packaging technique which has two devices per unit cell with shared magnetic bias and utilizing coaxial spring pin vertical interconnects provides a dual stacked stripline circulator 100 satisfactory for use in a dual-polarized wideband active array antenna.

Figure 2A:
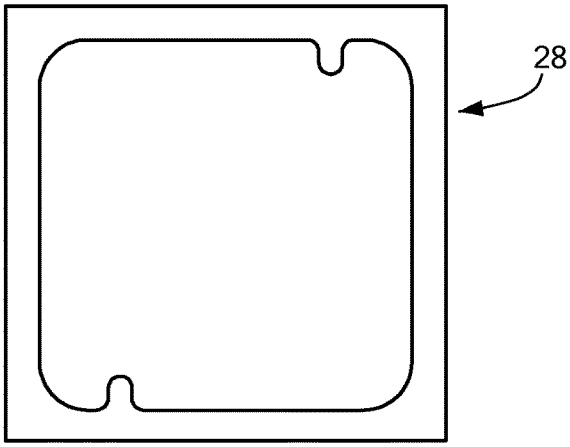
FIGS. 2A to 2F are top perspective views of portions of the dual stacked stripline circulator during fabrication according to the disclosure.

Referring now to FIG. 2A, a dual composite disc with dielectric material 20 is shown where the dual composite disc 21 includes an inner central portion 22 of high saturation magnetization material and an outer portion 24 of low saturation magnetization material encircling the central inner portion 22 and a dielectric material 26 encircling the outer portion 24 of the dual composite disc 21 as shown. Also shown is a frame 28 used to support the dielectric substrate material 26 during fabrication, but is disposed of once the dual composite disc with dielectric material 20 is fabricated. It should be noted that instead of using the dielectric material 26, the low saturation magnetization material could be used alternatively. One technique to fabricate the initial dual composite disc with dielectric material 20 as shown is to start with a block of dielectric material and drill out a hole and hill the hole with a low saturation magnetization material using a high temperature adhesive between the two materials. Once the low saturation magnetization material is bound to the dielectric material, drill out a smaller hole in the low saturation magnetization material and fill the hole with high saturation magnetization material using a high temperature adhesive between the two materials. Once the high saturation magnetization material is bound to the low saturation magnetization material, the block can be sliced to the desired thickness and then ground to the final thickness to provide the dual composite disc with dielectric material 20. To correct any deficiencies in the thickness of the dielectric material, a thick film dielectric material is printed on the front side and the back side of the dual composite disc with dielectric material 20 to ensure the front side and the back side is planar. The latter will fill in any gaps left on the front or the backside of the composite disc especially at the transitions between the high saturation magnetization material and the low saturation magnetization material and between the low saturation magnetization material and the dielectric material and later allow thick film metallization to be disposed across the surface and then etched to provide a metallization layer as described later. The frame 28 is cut from the dual composite disc with dielectric material 20 using known techniques.

Figure 2B:
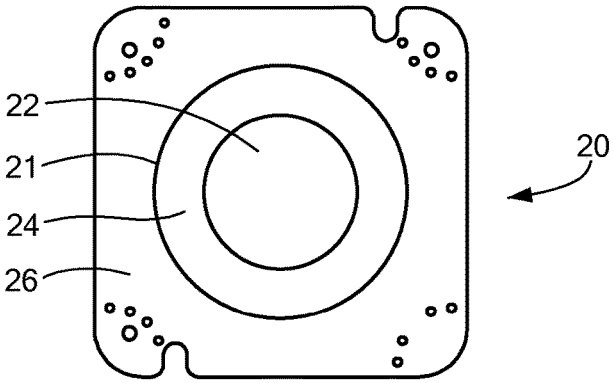
Figure 2B:
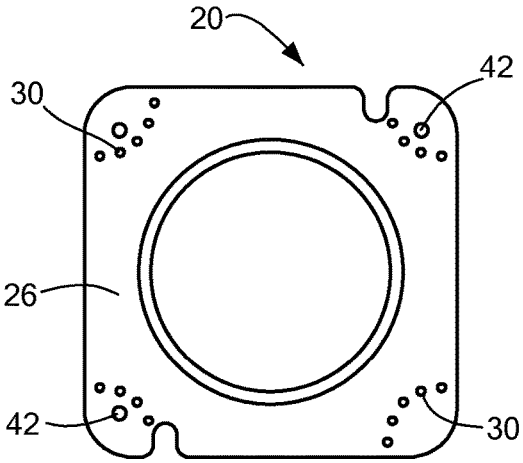

Referring now to FIG. 2B, thru-holes are drilled through the dielectric material 26 as required and filled with gold (Au) to provide metalized thru-holes 30 to correspond to the circuitry as described further herein. Alignment holes are also provided in each one of the substrates to facilitate alignment as the substrates are stacked on each other.

Figure 2C:
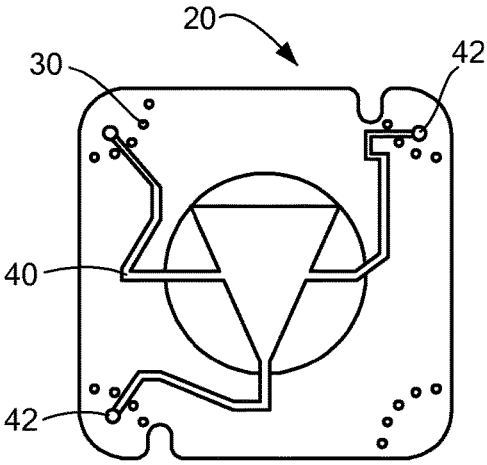

Referring now to FIG. 2C, a metallization layer 40 is shown where a gold conductor paste using thick film metallization process techniques was spread on the front and backside of the dual composite disc with dielectric material 20 and then dried at 150 degrees C. and then fired at 850 degrees C. A photo resist is applied, developed and etched on the front and back side to provide the desired metallization pattern as shown in FIG. 2C. It should be noted the backside of the dual composite disc with dielectric material 20 is primarily a ground plane with openings disposed to accommodate the gold filled thru-holes 30. The latter is performed for each of the substrates 101, 102, 103 and 104 where the desired metallization pattern is etched on one side of the dual composite disc with dielectric material 20 and a ground plane with openings disposed to accommodate the gold filled thru-holes 30 on the other side of the dual composite disc with dielectric material 20. It should be appreciated desired metallization pattern is a mirror image of each other for substrates 101 and 102 and the desired metallization pattern is a mirror image of each other for substrates 103 and 104. The requisite metallization pattern needed to fabricate each of the circulators is well known in the art and will depend on the frequency and bandwidth requirements of the application. The technique used to fabricate the dual stacked stripline circulator 100 is not dependent on any specific metallization pattern and any known metallization pattern used for y-junction circulators may be used.

Figure 2D:
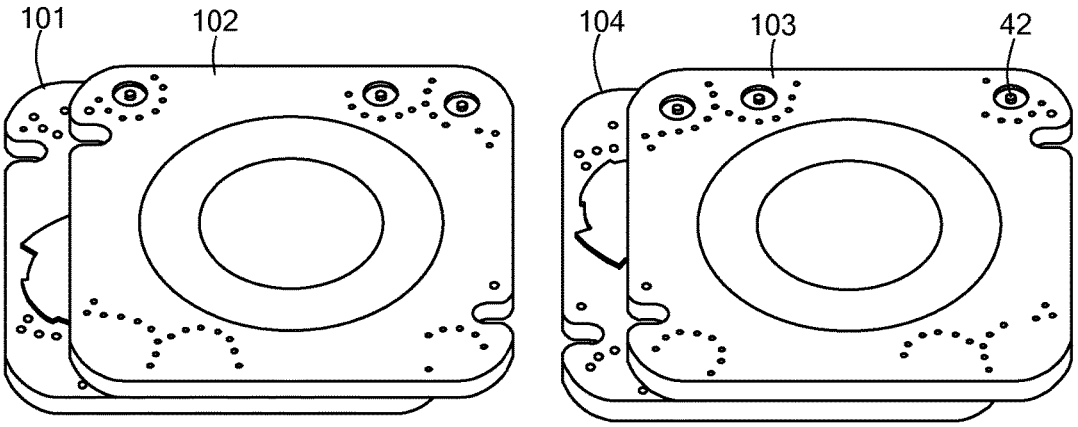

Referring now to FIG. 2D, the substrate 103 is bonded to the substrate 104 and in a similar manner the substrate 101 is bonded to substrate 102. In preparation, a thick film sealing glass is printed on a surface of the substrates 101 and 103 and dried at 150 degrees C. and a thick film gold via fill is printed on substrates 101 and 103 and dried at 150 degrees C. In a similar manner, a thick film gold via fill is printed on substrates 102 and 104 and substrate 103 is mounted with substrate 104 and substrate 101 is mounted with substrate 102 and dried at 150 degrees C. The stacked substrates 103 and 104 and the stacked substrates 101 and 102 are then fired at 750 degrees C. This generates a first pair of stacked substrates and a second pair of stacked substrates ready for further processing. Also shown in FIG. 2D is an RF port 42 which extends through the substrate and is connected to metallization pattern 40 to provide a signal path.

Figure 2E:
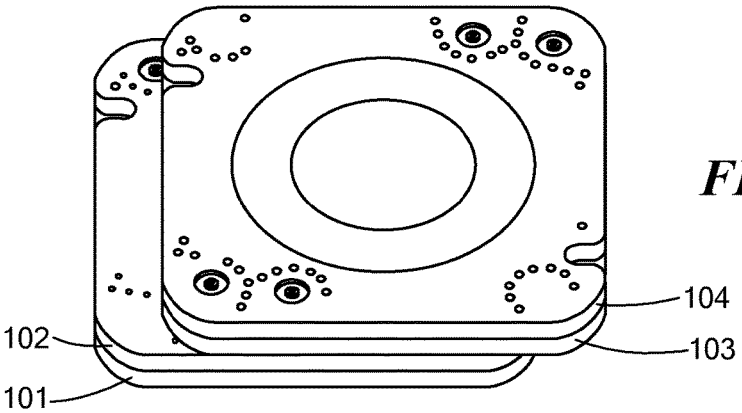

Referring now to FIG. 2E, the stacked substrates 101 and 102 are bonded to the stacked substrates 103 and 104. In preparation, thick film gold via fill is printed on the back side of the stacked substrates 103 and 104 which are then mounted with the stacked substrates 101 and 102 to provide a stacked substrate assembly 112 and dried at 150 degrees C. The stacked substrate assembly 112 which includes the combined stacked substrates 101, 102, 103 and 104 is then fired at 750 degrees C. Also shown in FIG. 2E are vent holes 44 to allow gasses to vent when the stacked substrates are mounted together and cured.

Figure 2F:
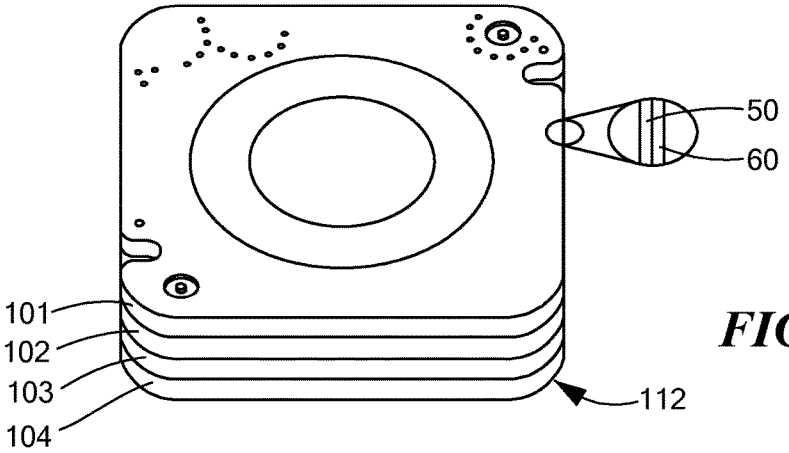

Referring now to FIG. 2F, to finalize the circulator stack, an edge wrap sealing glass 50 is disposed on the stacked substrate assembly 112 and then an edge wrap gold thick paste 60 is disposed on the edge of the stacked substrate assembly 112. The latter is then dried at 150 degrees C. and then fired at 550 degrees C.

Figure 3:
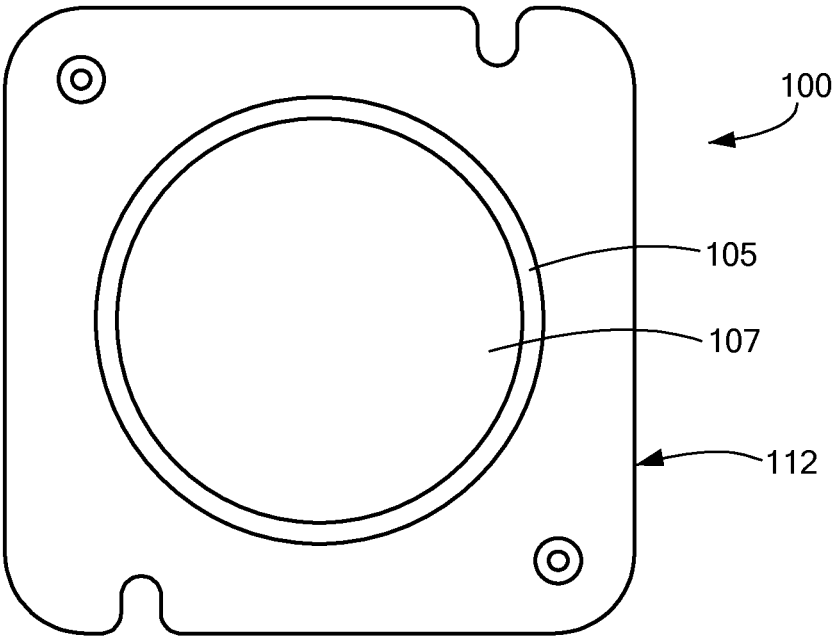
FIG. 3 is a top perspective view of a dual stacked stripline circulator fabricated using the steps shown in FIGS. 2A-2F according to the disclosure.
Figure 3A:
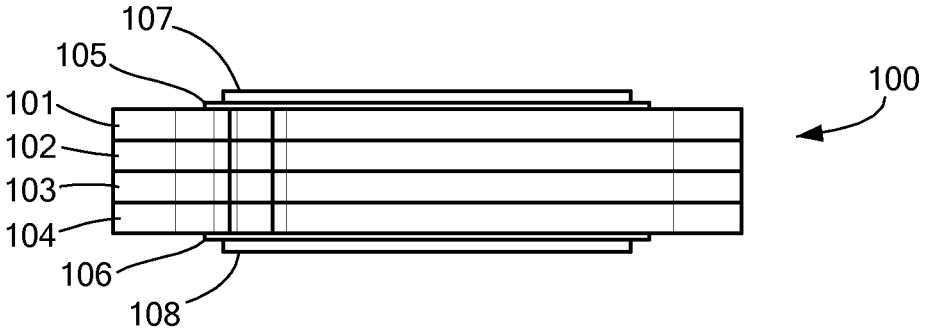
FIG. 3A is a side perspective view of a dual stacked stripline circulator fabricated using the steps shown in FIGS. 2A-2F according to the disclosure.

Referring now to FIGS. 3 and 3A, completing the dual stacked stripline circulator 100, a pole piece 105 and a pole piece 106 are disposed on the top and the bottom, respectively, of the stacked substrate assembly 112 and then a permanent magnet 107 is disposed on the pole piece 105 and a permanent magnet 108 is disposed on the pole piece 106. Referring again to FIG. 1B, the stacked substrate assembly 112 is mounted to the cold plate 110 to dissipate heat to mitigate overheating.

Referring again to FIG. 1A, it can be seen that the dual stacked stripline circulator 100 includes the four ferrite substrates, 101, 102, 103 and 104, in the illustrated example each typically having a thickness of 0.1 inches separated by a glass/via filled layer 109 typically having a thickness of 0.0015 inches. A pole piece 105 typically having a thickness of 0.015 inches is mounted with substrate 101 with a layer 113 between the pole piece 105 and the substrate 101 typically having a thickness of 0.002 inches. A permanent magnet 107 typically having a thickness of 0.030 inches is mounted with pole piece 105 with a bonding layer 114 typically having a thickness of 0.002 inches. A pole piece 106 typically having a thickness of 0.050 inches is mounted with substrate 104 with a layer 115 between the pole piece 105 and the substrate 101 typically having a thickness of 0.002 inches. A permanent magnet 108 typically having a thickness of 0.030 inches is mounted with pole piece 106 with a bonding layer 116 typically having a thickness of 0.002 inches. The latter provides a dual stacked stripline circulator 100 having a thickness typically of 0.5025 inches. It should be appreciated the latter thickness may vary depending on the tolerances maintained for each of the individual layers, but provides the preferred dimensions for a multi junction circulator operating in the 0.5 to 2.0 GHz band. It should be appreciated by one skilled in the art the dimensions would vary accordingly if a different operating band is utilized.

Figure 4:
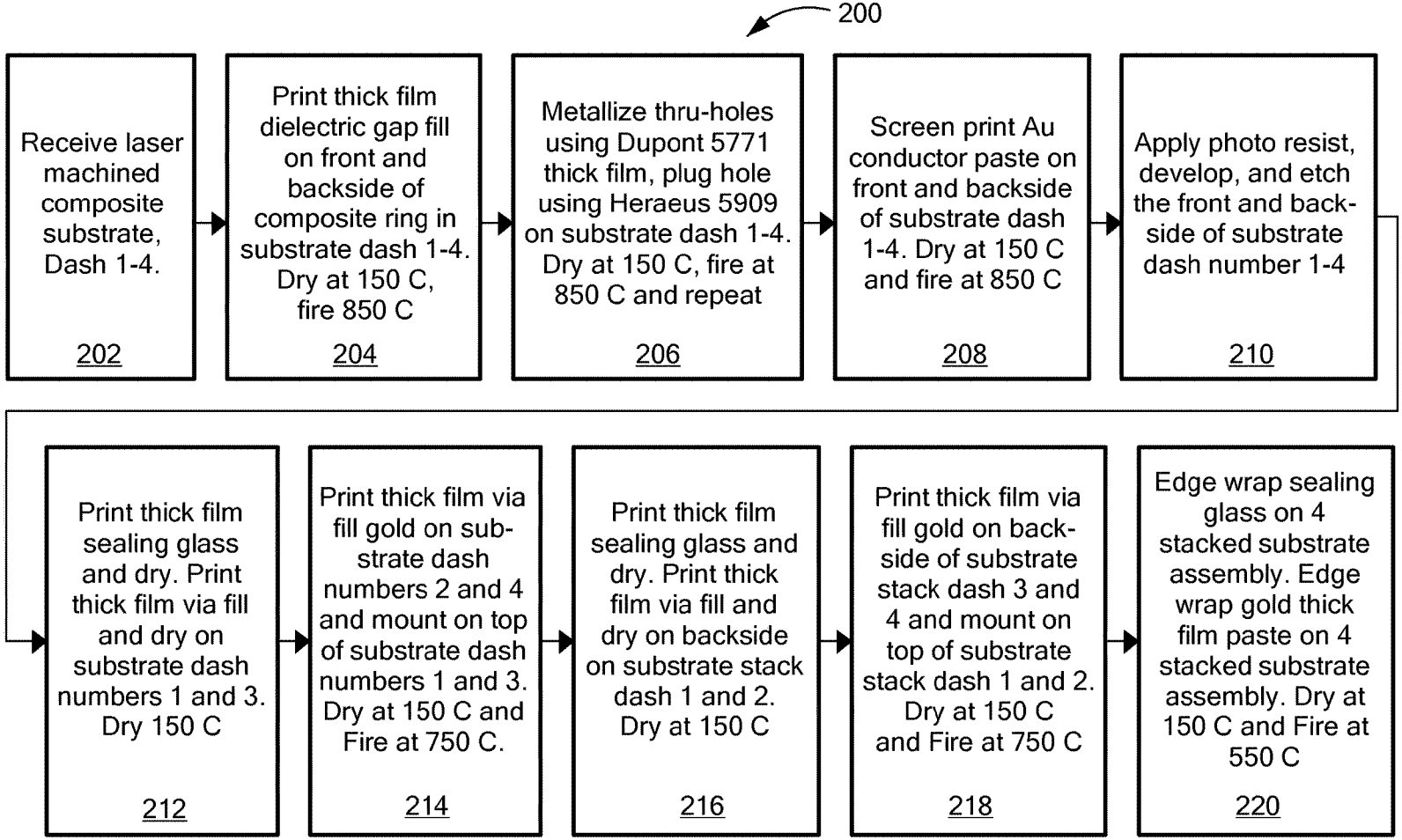
FIG. 4 is a diagram showing the various steps used to fabricate a dual stacked stripline circulator according to the invention.

Referring now to FIG. 4, a fabrication process 200 is shown to fabricate the dual stacked stripline circulator 100. First, a laser machined composite substrate is received where the substrate includes a dual composite disc fabricated within the substrate as shown by step 202. As described earlier in connection with FIG. 2A, a composite disc with dielectric material 20 includes an inner central portion 22 of high saturation magnetization material and an outer portion 24 of low saturation magnetization material encircling the central inner portion 22 and a dielectric material 26 encircling the outer portion 24 of the dual composite disc 21. Next, as shown in step 204, a thick film dielectric gap fill is printed on the front side and the back side of the composite disc with dielectric material 20 (also sometimes referred to as a composite ring) and dried at 150 degrees C. and then fired at 850 degree C. Next, as shown in step 206, the thru-holes are metalized, the holes are plugged in the substrate, and dried at 150 degrees C. and then fired at 850 degrees C. and repeated as necessary.

Next, as shown is step 208, gold conductor paste is screen printed on the front and back side of the substrate, dried at 150 degrees C. and fired at 850 degrees C. Next, as shown in step 210, photo resist is applied, developed, and the front side and back side of each of the substrates 101, 102, 103 and 104 are etched. Next, as shown in step 212, a thick film sealing glass is printed on the front side and back side of each of the substrates 101, 102, 103 and 104 and dried and then a thick film via fill is printed on the front side and hack side of each of the substrates 101 and 103 and dried at 150 degrees C. Next, as shown in step 214, a thick film gold via fill is printed on substrates 102 and 104 and substrate 102 is mounted with substrate 101 and substrate 104 is mounted with substrate 103 and dried at 150 degrees C. and then fired at 750 degrees C. Next, as shown in step 216, thick film sealing glass is printed on the substrates and dried and then thick film gold via fill is printed on the backside of the substrate stack with substrate 101 and 102 and dried at 150 degrees C.

Next, as shown in step 218, thick film gold via fill is printed on back side of the substrate stack with substrates 103 and 104 and substrates 103 and 104 are mounted with the substrate stack with substrates 101 and 102 and dried at 150 degrees C. The stacked substrate assembly 112 is then fired at 750 degrees C. Next, as shown in step 220, sealing glass 50 is edge wrapped or encircled around the stacked substrate assembly 112, and then gold thick film paste is edged wrapped or encircled around the stacked substrate assembly 112 and dried at 150 degrees C. and then fired at 550 degrees C.

To complete the dual stacked stripline circulator 100, pole pieces are placed on universal tape ring frame boats (not shown) and an adhesive is printed on each pole piece. A magnet is placed on the adhesive and the magnet assembly is cured in an oven. Next, the circulator stacks are placed on universal tape ring frame boats and an adhesive is applied to each circulator stack. A magnet assembly (pole piece and magnet) is placed on each circulator stack and cured in an oven. Then the process is repeated to place a magnet assembly on the back side of each circulator stack. The latter steps provide a dual stacked stripline circulator 100 as shown in FIG. 3A according to the disclosure.

It should now be appreciated that with such an arrangement, the dual stacked stripline circulator 100 is preferable for the packaging used to minimize array depth, works well for X band and below, for example, 0.5 to 2.0 GHz, with a thickness of approximately 0.50 inches vs 4.0 inches for brick packaging. With dual polarization, each unit cell of the array requires two circulators which are accomplished by the disclosure and the circulators share a magnetic bias circuit. The following features are taught by the disclosure; a circulator constructed using thick film post-fired substrate stacking to include: thick film sealing glass for substrate stack bonding, layer to layer and substrate to substrate via interconnects, metallization and patterning across the gaps between composite materials, mirrored etched stripline circuit metallization on top and bottom of the substrates and their interconnection, and the disclosure uses stacked circulators in a tile architecture to reduce depth and weight for a dual-polarized wideband active array antenna. The overall packaging technique which has two devices per unit cell with shared magnetic bias and utilizing coaxial spring pin vertical interconnects provides a compact feed structure for a tile array.

A number of embodiments of the disclosure have been described. Nevertheless, it will be understood that various modifications may be made without departing from the spirit and scope of the disclosure. Accordingly, other embodiments are within the scope of the following claims.

What is claimed is:

1. A method of providing a dual stacked stripline circulator comprising:

forming a first substrate with a first composite ferrite disc having an inner portion with a high saturation magnetization material and an outer portion of a low saturation magnetization material;

forming a second substrate with a second composite ferrite disc having an inner portion with a high saturation magnetization material and an outer portion of a low saturation magnetization material;

forming a third substrate with a third composite ferrite disc having an inner portion with a high saturation magnetization material and an outer portion of a low saturation magnetization material;

forming a fourth substrate with a fourth composite ferrite disc having an inner portion with a high saturation magnetization material and an outer portion of a low saturation magnetization material;

disposing a first pattern defining three ports of a first three-port circulator on each of the first substrate and the second substrate;

disposing a second pattern defining three ports of a second three-port circulator on each of the third substrate and the fourth substrate;

stacking the first substrate, the second substrate, the third substrate and the fourth substrate comprising bonding the first substrate with the second substrate and bonding the third substrate with the fourth substrate and then bonding the first and second substrates with the third and fourth substrates to provide a stacked substrate assembly; and disposing a metal film around the stacked substrate assembly.

2. The method of providing a dual stacked stripline circulator as recited in claim 1 comprising: printing a thick film dielectric gap fill on each side of each one of the first substrate, the second substrate, the third substrate and the fourth substrate.

3. The method of providing a dual stacked stripline circulator as recited in claim 1 comprising printing a thick film sealing glass about the first pattern and printing a thick film sealing glass about the second pattern.

4. The method of providing a dual stacked stripline circulator as recited in claim 1 comprising disposing sealing glass on the first, second, third and fourth substrate to bond the substrates together.

5. The method of providing a dual stacked stripline circulator as recited in claim 1 comprising:

attaching a magnet to a pole piece to form a first magnet assembly;

attaching the first magnet assembly to the first substrate;

attaching a magnet to a pole piece to form a second magnet assembly; and attaching the second magnet assembly to the fourth substrate.

6. The method of providing a dual stacked stripline circulator as recited in claim 1 wherein the inner portion of a composite ferrite disc is bonded to the outer portion of a composite ferrite disc with a high temperature adhesive.

7. A method of providing a dual stacked stripline circulator comprising:

forming a first substrate with a first composite ferrite disc having an inner portion with a high saturation magnetization material and an outer portion of a low saturation magnetization material;

forming a second substrate with a second composite ferrite disc having an inner portion with a high saturation magnetization material and an outer portion of a low saturation magnetization material;

forming a third substrate with a third composite ferrite disc having an inner portion with a high saturation magnetization material and an outer portion of a low saturation magnetization material;

forming a fourth substrate with a fourth composite ferrite disc having an inner portion with a high saturation magnetization material and an outer portion of a low saturation magnetization material;

printing a thick film dielectric gap fill on each side of each one of the first substrate, the second substrate, the third substrate and the fourth substrate;

disposing a first pattern defining three ports of a first three-port circulator on each of the first substrate and the second substrate;

disposing a second pattern defining three ports of a second three-port circulator on each of the third substrate and the fourth substrate;

stacking the first substrate, the second substrate, the third substrate and the fourth substrate; and disposing a metal film around the first, second, third and fourth substrate.

8. The method of providing a dual stacked stripline circulator as recited in claim 7 comprising printing a thick film sealing glass about the first pattern and printing a thick film sealing glass about the second pattern.

9. The method of providing a dual stacked stripline circulator as recited in claim 7 comprising disposing sealing glass on the first, second, third and fourth substrate to bond the substrates together.

10. The method of providing a dual stacked stripline circulator as recited in claim 7 comprising:

attaching a magnet to a pole piece to form a first magnet assembly;

attaching the first magnet assembly to the first substrate;

attaching a magnet to a pole piece to form a second magnet assembly; and attaching the second magnet assembly to the fourth substrate.

11. The method of providing a dual stacked stripline circulator as recited in claim 7 wherein the inner portion of a composite ferrite disc is bonded to the outer portion of a composite ferrite disc with a high temperature adhesive.

* * * * *